US009454095B2

(12) United States Patent
Miyamoto

(10) Patent No.: US 9,454,095 B2
(45) Date of Patent: Sep. 27, 2016

(54) ELECTROPHOTOGRAPHIC TONER

(71) Applicant: KYOCERA Document Solutions Inc., Osaka (JP)

(72) Inventor: Hidetoshi Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/578,899

(22) Filed: Dec. 22, 2014

(65) Prior Publication Data

US 2015/0185649 A1 Jul. 2, 2015

(30) Foreign Application Priority Data

Dec. 26, 2013 (JP) ..... 2013-268278

(51) Int. Cl.
*G03G 9/093* (2006.01)
*G03G 9/08* (2006.01)

(52) U.S. Cl.
CPC ..... *G03G 9/0825* (2013.01); *G03G 9/09328* (2013.01); *G03G 9/09371* (2013.01); *G03G 9/09392* (2013.01)

(58) Field of Classification Search
CPC ..... G03G 9/09314; G03G 9/09328
See application file for complete search history.

(56) References Cited

U.S. PATENT DOCUMENTS 4,497,885 A * 2/1985 Ushiyama ..... G03G 9/09307 430/110.2
4,642,281 A * 2/1987 Kakimi ..... G03G 9/09378 430/108.4
2005/0271964 A1 12/2005 Etou et al.
2015/0072281 A1 3/2015 Okada
2015/0079517 A1 3/2015 Kikushima

FOREIGN PATENT DOCUMENTS

EP 2849000 A1 3/2015
EP 2849001 A1 3/2015
JP 2004-294468 A 10/2004
JP 2004-294469 A 10/2004

OTHER PUBLICATIONS

The extended European search report issued by the European Patent Office on Apr. 29, 2015, which corresponds to European Patent Application No. 14199928.4 - 1303 and is related to U.S. Appl. No. 14/578,899.

* cited by examiner

*Primary Examiner* — Hoa V Le
(74) *Attorney, Agent, or Firm* — Studebaker & Brackett PC

(57) ABSTRACT

An electrophotographic toner includes capsule toner particles that each include an anionic toner core having a zeta potential at pH 4 of no greater than −5 mV and a cationic shell layer disposed over a surface of the toner core. Each of the capsule toner particles has, at a surface thereof, a sodium concentration of no less than 200 ppm and no greater than 1,000 ppm as measured by an ICP spectrometer.

2 Claims, 1 Drawing Sheet

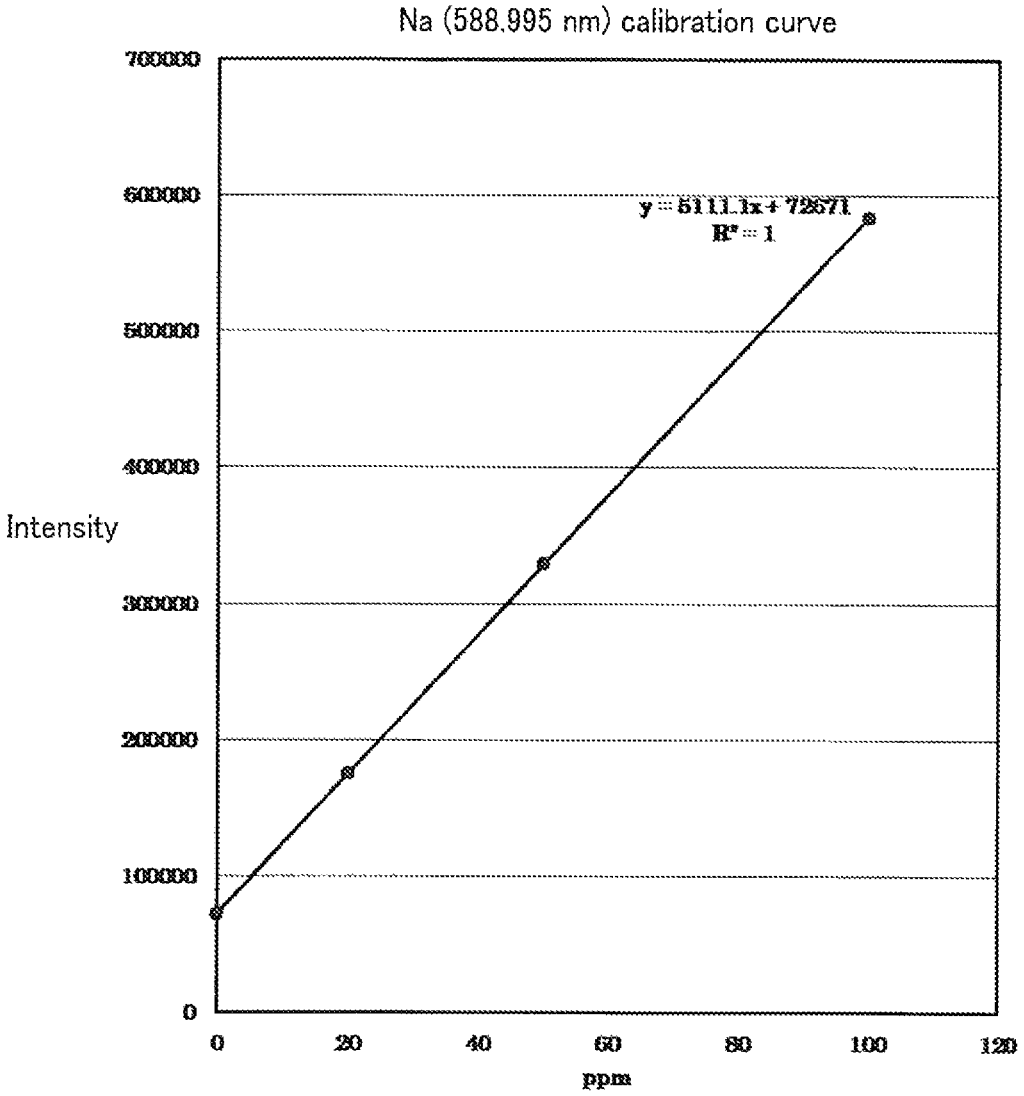
Na (588.995 nm) calibration curve
700000
600000
500000
400000
300000
200000
100000
0
Intensity
y = 5111.1x + 72671
R² = 1
0
20
40
60
80
100
120
ppm

ELECTROPHOTOGRAPHIC TONER

INCORPORATION BY REFERENCE

The present application claims priority under 35 U.S.C. §119 to Japanese Patent Application No. 2013-268278, filed Dec. 26, 2013. The contents of this application are incorporated herein by reference in their entirety.

BACKGROUND

The present disclosure relates to an electrophotographic toner, and in particular relates to a capsule toner.

A capsule toner includes cores and shell layers (capsule layers) disposed over the surface of the cores. A commonly known method of manufacturing a toner involves coating the surface of cores with shell layers while the cores, in a solid state, are dispersed in an aqueous medium having a dispersant dissolved therein.

Due to an anionic dispersant being used in such a manufacturing method, it is thought that aggregation of the cores can be inhibited if the anionic dispersant can be caused to adhere to the surface of the cores. Unfortunately, it is difficult to cause a dispersant having a small molecular weight to adhere to the surface of the cores because the dispersant has a high tendency to dissolve in the aqueous medium. On the other hand, a dispersant having a large molecular weight may function as a coagulant for large molecules and as a result tends to cause aggregation of the cores.

In consideration of the above, a technique has been proposed in which a capsule toner can be obtained without using an electrolytic material such as an anionic dispersant, by using cores that are anionic. More specifically, the aforementioned technique involves attraction of a cationic film forming material (shell layer material) toward the surface of the cores and polymeric fixing of the capsulation material (shell layer material) through in-situ polymerization to yield a dense capsule toner. In a situation in which a capsulation material (shell layer material) is attracted directly to the surface of a toner and caused to polymerize without using an anionic additive (for example, a dispersant), aggregation of toner particles does not occur during capsule formation, even if the glass transition point Tg of a binder resin—constituting a major component of the cores—is lower than the curing temperature of the shell layer material, and thus a dense capsule toner can be obtained.

SUMMARY

An electrophotographic toner according to the present disclosure includes capsule toner particles that each include an anionic toner core having a zeta potential at pH 4 of no greater than −5 mV and a cationic shell layer disposed over a surface of the toner core. Each of the capsule toner particles has, at a surface thereof, a sodium (Na) concentration of no less than 200 ppm and no greater than 1,000 ppm as measured by an inductively coupled plasma (ICP) spectrometer.

BRIEF DESCRIPTION OF THE DRAWINGS

FIG. 1 is a graph illustrating a calibration curve for Na at a wavelength of 588.995 nm.

DETAILED DESCRIPTION

The following explains an embodiment of the present disclosure, but the present disclosure is of course not limited to the embodiment.

An electrophotographic toner (herein also referred to simply as a toner) according to the present embodiment is a capsule toner for developing an electrostatic latent image. The toner according to the present embodiment includes a large number of capsule toner particles (herein also referred to simply as toner particles).

Each of the toner particles includes an anionic toner core (herein also referred to simply as a core) and a cationic shell layer disposed over the surface of the core. The toner particles may optionally include an external additive in accordance with necessity thereof.

The cores contain a binder resin (binding agent) and internal additives (for example, a colorant, a releasing agent, a charge control agent, and a magnetic powder). The cores are coated by the shell layers. The external additive adheres to the surface of the shell layers. However, the toner particles are not limited to having the composition described above. For example, the internal and external additives may be omitted in a situation in which such additives are not necessary. Also, each of the toner particles may optionally include a plurality of shell layers disposed over the surface of the core. When the toner particles have a structure in which a plurality of shell layers are layered one on top of another, a most outward of the shell layers is preferably cationic.

As a result of the cores being anionic, a cationic material of the shell layers can be attracted toward the surface of the cores during shell layer formation. In a more specific example, the shell layer material which has a positive charge in an aqueous medium is electrically attracted toward the cores which have a negative charge in the aqueous medium, and the shell layers are formed over the surface of the cores. Through the above process, uniform shell layers can be readily formed on the surface of the toner cores without needing to use a dispersant in order to achieve a high degree of dispersion of the cores in the aqueous medium.

The binder resin constitutes a large proportion (for example, at least 85%) of components contained in the cores. Therefore, the polarity of the binder resin has a significant influence on the overall polarity of the cores. The cores tend to be anionic when the binder resin has a group such as an ester group, a hydroxyl group, an ether group, an acid group, or a methyl group. On the other hand, the cores tend to be cationic when the binder resin has a group such as an amino group, an amine, or an amide group.

In the present embodiment, the cores having a negative zeta potential in an aqueous medium adjusted to pH 4 (herein referred to simply as a zeta potential at pH 4) is used as an indicator that the cores are anionic. In order that the cores have good anionic strength, the cores preferably have a zeta potential at pH 4 of no greater than −5 mV, and more preferably of no greater than −10 mV.

Examples of methods for measuring the zeta potential include an electrophoresis method, an ultrasound method, and an electric sonic amplitude (ESA) method.

The electrophoresis method involves applying an electrical field to a liquid dispersion of particles, thereby causing electrophoresis of charged particles in the dispersion, and calculating the zeta potential based on the rate of electrophoresis. An example of the electrophoresis method is laser Doppler electrophoresis in which particles undergoing electrophoresis are irradiated with laser light and the rate of electrophoresis is calculated from an amount of Doppler shift of scattered light that is obtained. Advantages of laser Doppler electrophoresis are a lack of necessity for particle concentration in the dispersion to be high, a low number of parameters being necessary for calculating the zeta potential, and a good degree of sensitivity in detection of the rate of electrophoresis.

The ultrasound method involves irradiating a liquid dispersion of particles with ultrasound, thereby causing vibration of electrically charged particles in the dispersion, and calculating the zeta potential based on an electric potential difference that arises due to the vibration.

The ESA method involves applying a high frequency voltage to a liquid dispersion of particles, thereby causing electrically charged particles in the dispersion to vibrate and generate ultrasound, and calculating the zeta potential based on magnitude (intensity) of the ultrasound.

An advantage of the ultrasound and ESA methods is that the zeta potential can be measured to a good degree of sensitivity even when particle concentration of the dispersion is high (for example, exceeding 20% by mass).

The cores having a triboelectric charge of no greater than −10 μC/g with a standard carrier can alternatively be used as an indicator that the cores are anionic. The triboelectric charge is an indicator of whether the cores are charged to a positive or negative polarity and of how readily the cores are charged. The triboelectric charge of the cores upon rubbing with the standard carrier can for example be measured using a Q/m meter (for example, a Model 210HS-2A produced by Trek, Inc.).

The following explains the overall composition of the cores included in the toner particles, the binder resin, the internal additives (colorant, releasing agent, charge control agent, and magnetic powder), the overall composition of the shell layers, the components of the shell layers (charge control agent), and the external additive.

{Cores}

The cores included in the toner particles according to the present embodiment contain a binder resin and internal additives (a colorant, a releasing agent, a charge control agent, and a magnetic powder). However, it is not essential that the cores include all of the components listed above and non-essential components (for example, the colorant, the releasing agent, the charge control agent, and the magnetic powder) may be omitted if, based on the intended use of the toner, such components are unnecessary.

{Binder Resin (Cores)}

The binder resin for example preferably has an ester group, a hydroxyl group, an ether group, an acid group, a methyl group, a carboxyl group, or an amino group as a functional group. The binder resin preferably has a functional group such as a hydroxyl group, a carboxyl group, or an amino group in molecules thereof, and more preferably has either or both of a hydroxyl group and a carboxyl group in molecules thereof. As a result of the cores (binder resin) having a functional group such as described above, the cores can readily react with a shell layer material (for example, methylol melamine) to form chemical bonds. Such chemical bonds cause strong bonding between the cores and the shell layers.

The binder resin is preferably a thermoplastic resin. Preferable examples of the thermoplastic resin include styrene-based resins, acrylic-based resins, styrene-acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene based resins. Among the thermoplastic resins listed above, styrene-acrylic-based resins and polyester resins are preferable due to having excellent properties in terms of dispersibility of the colorant in the toner, chargeability of the toner, and fixability of the toner on a recording medium.

(Styrene-Acrylic-Based Binder Resins)

A styrene-acrylic-based resin that can be used as the binder resin is for example a copolymer of a styrene-based monomer and an acrylic-based monomer.

Preferable examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic-based monomer include (meth)acrylic acid, alkyl (meth)acrylates, and hydroxyalkyl (meth)acrylates.

Note that the term "(meth)acrylic" is used as a generic term for both acrylic and methacrylic.

Preferable examples of alkyl (meth)acrylates include methyl (meth)acrylate, ethyl (meth)acrylate, n-propyl (meth)acrylate, iso-propyl (meth)acrylate, n-butyl (meth) acrylate, iso-butyl (meth)acrylate, and 2-ethylhexyl (meth) acrylate.

Preferable examples of hydroxyalkyl (meth)acrylates include 2-hydroxyethyl (meth)acrylate, 3-hydroxypropyl (meth)acrylate, 2-hydroxypropyl (meth)acrylate, and 4-hydroxypropyl (meth)acrylate.

A hydroxyl group can be introduced into the styrene-acrylic-based resin by using a monomer including a hydroxyl group (for example, p-hydroxystyrene, m-hydroxystyrene, or a hydroxyalkyl (meth)acrylate) during preparation of the styrene-acrylic-based resin. The hydroxyl value of the styrene-acrylic-based resin can for example be adjusted by appropriately adjusting the amount of the monomer including the hydroxyl group that is used in preparation of the styrene-acrylic-based resin.

A carboxyl group can be introduced into the styrene-acrylic-based resin by using (meth)acrylic acid as a monomer during preparation of the styrene-acrylic-based resin. The acid value of the styrene-acrylic-based resin can for example be adjusted by appropriately adjusting the amount of (meth)acrylic acid that is used in preparation of the styrene-acrylic-based resin.

In order to improve strength and fixability of the cores, the styrene-acrylic-based resin included in the binder resin preferably has a number average molecular weight (Mn) of no less than 2,000 and no greater than 3,000. The styrene-acrylic-based resin preferably has a molecular weight distribution (i.e., a ratio Mw/Mn of mass average molecular weight (Mw) relative to number average molecular weight (Mn)) of no less than 10 and no greater than 20. Mn and Mw of the binder resin can be measured by gel permeation chromatography.

(Polyester Binder Resins)

A polyester resin that can be used as the binder resin is for example obtained through condensation polymerization or condensation copolymerization of a di-, tri-, or higher-hydric alcohol component and a di-, tri-, or higher-basic carboxylic acid component.

Preferable examples of the di-, tri-, or higher-hydric alcohol component include diols, bisphenols, and tri- or higher-hydric alcohols.

Specific examples of preferable diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of preferable bisphenols include bisphenol A, hydrogenated bisphenol A, polyoxyethylenated bisphenol A, and polyoxypropylenated bisphenol A.

Specific examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the di-, tri-, or higher-basic carboxylic acid component include di-, tri-, and higher-basic carboxylic acids. Alternatively, an ester-forming derivative of any of the above-listed carboxylic acid components may be used (for example, an acid halide, an acid anhydride, or a lower alkyl ester). Herein the term "lower alkyl" refers to an alkyl group having 1 to 6 carbon atoms.

Specific examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acids, and alkenyl succinic acids. Preferable examples of alkyl succinic acids include n-butylsuccinic acid, isobutylsuccinic acid, n-octylsuccinic acid, n-dodecylsuccinic acid, and isododecylsuccinic acid. Preferable examples of alkenyl succinic acids include n-butenylsuccinic acid, isobutenylsuccinic acid, n-octenylsuccinic acid, n-dodecenylsuccinic acid, and isododecenylsuccinic acid. Specific examples of preferable tri- or higher-basic carboxylic acids include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The acid value and the hydroxyl value of the polyester resin can be adjusted by appropriately adjusting the amount of the di-, tri-, or higher-hydric alcohol component and the amount of the di-, tri-, or higher-basic carboxylic acid component used during preparation of the polyester resin. Increasing the molecular weight of the polyester resin tends to decrease the acid value and the hydroxyl value of the polyester resin.

In order to improve strength and fixability of the cores, the polyester resin included in the binder resin preferably has a number average molecular weight (Mn) of no less than 1,200 and no greater than 2,000. The polyester resin preferably has a molecular weight distribution (i.e., a ratio Mw/Mn of mass average molecular weight (Mw) relative to number average molecular weight (Mn)) of no less than 9 and no greater than 20. Mn and Mw of the binder resin can be measured by gel permeation chromatography.

In order that the binder resin is strongly anionic, the hydroxyl value (OHV) and the acid value (AV) of the binder resin are each preferably no less than 10 mg KOH/g.

The binder resin preferably has a solubility parameter (SP) value of no less than 10, and more preferably no less than 15. As a result of the SP value of the binder resin being no less than 10, affinity of the binder resin toward water is improved due to the SP value of the binder resin being closer to the SP value of water (23), and thus wettability of the binder resin in an aqueous medium is improved. Therefore, dispersibility of the binder resin in an aqueous medium is improved without using a dispersant and, as a consequence, a uniform dispersion of fine particles of the binder resin in an aqueous medium can be readily obtained.

The glass transition point (Tg) of the binder resin is preferably no greater than a curing initiation temperature of a capsulation material (thermosetting resin) contained in the shell layers. When a binder resin such as described above is used, sufficient fixability can be achieved even in a high-speed fixing system. The thermosetting resin is for example a melamine-based resin which typically has a curing initiation temperature of no less than 55° C. and no greater than 100° C. Therefore, Tg of the binder resin is preferably no less than 20° C. and no greater than 55° C., and more preferably no less than 30° C. and no greater than 50° C. As a result of Tg of the binder resin being no less than 20° C., the cores have a low tendency to aggregate during shell layer formation.

Tg of the binder resin can be measured by plotting a heat absorption curve of the binder resin using a differential scanning calorimeter (for example, a DSC-6200 produced by Seiko Instruments Inc.) and calculating Tg from a point of change in specific heat on the heat absorption curve. In a specific example of a method for calculating Tg of the binder resin, a 10 mg measurement sample of the binder resin is first placed in an aluminum pan. Next, a heat absorption curve is plotted for the binder resin, using an empty aluminum pan as a reference, under conditions of a measurement temperature range from no less than 25° C. to no greater than 200° C. and a heating rate of 10° C./minute. Tg of the binder resin is calculated from the heat absorption curve that is plotted.

The binder resin preferably has a softening point (Tm) of no greater than 100° C., and more preferably no greater than 95° C. As a result of Tm of the binder resin being no greater than 100° C., sufficient fixability can be achieved even during high speed fixing. Tm of the binder resin can be adjusted through combination of a plurality of binder resin materials that each have a different Tm.

Tm of the binder resin can for example be measured by placing a measurement sample of the binder resin in a capillary rheometer (for example, a CFT-500D produced by Shimadzu Corporation), causing melt flow of the sample under specific conditions in order to plot an S-shaped curve (S-shaped curve of temperature (° C.)/stroke (mm)), and reading Tm of the binder resin from the S-shaped curve that is plotted.

{Colorant (Cores)}

The cores may optionally contain a colorant. The colorant can for example be a commonly known pigment or dye that matches a color of the toner particles. The amount of the colorant is preferably no less than 1 part by mass and no greater than 20 parts by mass relative to 100 parts by mass of the binder resin, and more preferably no less than 3 parts by mass and no greater than 10 parts by mass.

(Black Colorants)

The cores of the toner particles according to the present embodiment may optionally contain a black colorant. The black colorant is for example carbon black. Alternatively, the black colorant may be a colorant that has been adjusted to a black color using colorants such as a yellow colorant, a magenta colorant, and a cyan colorant.

(Non-Black Colorants)

The cores of the toner particles according to the present embodiment may optionally contain a non-black colorant such as a yellow colorant, a magenta colorant, or a cyan colorant.

Preferable examples of the yellow colorant include condensed azo compounds, isoindolinone compounds, anthraquinone compounds, azo metal complexes, methine compounds, and arylamide compounds. Specific examples of preferable yellow colorants include C.I. Pigment Yellow (for example, 3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Preferable examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferable examples of the cyan colorant include copper phthalocyanine compounds, copper phthalocyanine derivatives, anthraquinone compounds, and basic dye lake compounds. Specific examples of preferable cyan colorants include C.I. Pigment Blue (for example, 1, 7, 15, 15:1, 15:2, 15:3, 15:4, 60, 62, and 66), Phthalocyanine Blue, C.I. Vat Blue, and C.I. Acid Blue.

{Releasing Agent (Cores)}

The cores may optionally contain a releasing agent. The releasing agent is for example used to improve fixability or offset resistance of the toner. In order to improve fixability and offset resistance of the toner, the amount of the releasing agent is preferably no less than 1 part by mass and no greater than 30 parts by mass relative to 100 parts by mass of the binder resin, and more preferably no less than 5 parts by mass and no greater than 20 parts by mass.

The releasing agent may preferably be an aliphatic hydrocarbon-based wax (for example, low molecular weight polyethylene, low molecular weight polypropylene, polyolefin copolymer, polyolefin wax, microcrystalline wax, paraffin wax, or Fischer-Tropsch wax). Alternatively, the releasing agent may preferably be an oxide of an aliphatic hydrocarbon-based wax (for example, polyethylene oxide wax or block copolymer of polyethylene oxide wax). Alternatively, the releasing agent may preferably be a plant wax (for example, candelilla wax, carnauba wax, Japan wax, jojoba wax, or rice wax). Alternatively, the releasing agent may preferably be an animal wax (for example, beeswax, lanolin, or spermaciti). Alternatively, the releasing agent may preferably be a mineral wax (for example, ozokerite, ceresin, or petrolatum). Alternatively, the releasing agent may preferably be a wax having a fatty acid ester as major component (for example, montanic acid ester wax or castor wax). Alternatively, the releasing agent may preferably be a wax in which a part or all of a fatty acid ester has been deoxidized (for example, deoxidized carnauba wax).

{Charge Control Agent (Cores)}

The cores may optionally contain a charge control agent. In the present embodiment, the cores are anionic (i.e., negatively chargeable) and thus the cores may contain a negatively chargeable charge control agent. The charge control agent is used in order to improve charge stability and a charge rise characteristic, thereby obtaining a toner having excellent properties in terms of durability and stability. The charge rise characteristic is an indicator of whether or not the toner particles are chargeable to a specific charge level in a short period of time.

{Magnetic Powder (Cores)}

In a configuration in which the toner is used as a one-component developer, the amount of the magnetic powder is preferably no less than 35 parts by mass and no greater than 60 parts by mass relative to 100 parts by mass of the toner overall, and more preferably no less than 40 parts by mass and no greater than 60 parts by mass.

Preferable examples of the magnetic powder include iron (for example, ferrite and magnetite), ferromagnetic metals (for example, cobalt and nickel), alloys of either or both of iron and a ferromagnetic metal, compounds containing either or both of iron and a ferromagnetic metal, ferromagnetic alloys subjected to ferromagnetization such as heat treatment, and chromium dioxide.

The magnetic powder preferably has a particle size of no less than 0.1 μm and no greater than 1.0 μm, and more preferably no less than 0.1 μm and no greater than 0.5 μm. As a result of the magnetic powder having a particle size in the range described above, the magnetic powder can be readily dispersed in a uniform manner throughout the binder resin.

Note that in the present embodiment, the anionic strength of the toner cores can be increased by adding strongly negatively chargeable fine particles such as dry silica to a toner core material (material of the toner cores), and causing the dry silica to adhere to the surface of the toner cores.

{Shell Layers (Shell Films)}

No particular limitation is placed on the shell layer material (herein also referred to as a capsulation material, shell forming agent, or shell forming material) used to form the shell layers (shell films), so long as the shell layer material is a material that can undergo so-called in-situ polymerization. In-situ polymerization refers to a process in which the cationic capsulation material (shell layer material) is ionically attracted toward the anionic capsule cores (core material or, in other words, the toner cores), and undergoes surface polymerization while adhered to the surface of the capsule cores. The shell layer material preferably contains a thermosetting material (a thermosetting resin, a derivative of a thermosetting resin, a monomer of a thermosetting resin, or prepolymer of a thermosetting resin), and more preferably contains a cationic thermosetting material. The material described above is preferably a resin including an amino group (—$NH_2$) (herein referred to as an amino resin), or a derivative, monomer, or prepolymer thereof. The amino resin, or the derivative, monomer, or prepolymer thereof, is for example a melamine resin, or a derivative, monomer (for example, either or both of melamine and methylol melamine), or prepolymer of a melamine resin. Another example of the amino resin, or the derivative, monomer, or prepolymer thereof, is a guanamine resin, or a derivative, monomer (for example, benzoguanamine), or prepolymer of a guanamine resin. Another example of the amino resin, or the derivative, monomer, or prepolymer thereof, is a urea resin, or a derivative, monomer, or prepolymer (for example, a prepolymer of urea and formaldehyde) of a urea resin. Other examples of the amino resin, or the derivative, monomer, or prepolymer thereof, include acetoguanamine, spiroguanamine, sulfonamide resins, glyoxal resins, and aniline resins.

Another example of the amino resin, or the derivative, monomer, or prepolymer thereof, is a material including nitrogen in a molecular framework thereof. The material including nitrogen in the molecular framework thereof is for example a thermosetting resin including nitrogen in the molecular framework thereof, and more specifically is for example a polyimide resin, a maleimide-based polymer, bismaleimide, amino-bismaleimide, or bismaleimide-triazine.

Another example of the amino resin, or the derivative, monomer, or prepolymer thereof, is an amino-aldehyde resin, or a derivative, monomer, or prepolymer thereof. The term amino-aldehyde refers to a resin produced by reacting an amine compound (for example, a triazine compound) such a melamine or guanamine with an aldehyde such as formaldehyde through addition polymerization to yield a methylolated compound (more generally, an alkylolated compound), and causing polycondensation of the methylolated compound. Specific examples of amino-aldehyde resins include melamine-formaldehyde resins, urea-formaldehyde resins, and melamine-urea-aldehyde resins.

The shell layer material is preferably a monomer or prepolymer of a nitrogen-containing amino-aldehyde resin (for example, a melamine resin, a guanamine resin, or a urea resin). Among such monomers and prepolymers, a melamine-formaldehyde initial condensate is preferable in terms of appropriate adsorption onto the surface of anionic solid particles in an aqueous medium during shell layer formation, and also in terms of maintaining dispersibility such that toner particles do not aggregate before a curing reaction of the shell layers can be completed. In order that the capsulation material is appropriately adsorbed onto the surface of anionic solid particles (toner cores) in an aqueous medium and undergoes in-situ polymerization on the surface of the toner cores, it is particularly important that an appropriate balance is achieved between affinity of the capsulation material toward water and affinity of the capsulation material toward the surface of the toner cores. Reasoning behind the above is that it is necessary that the capsulation material is adsorbed onto the surface of the toner cores and forms an interaction with functional groups (—OH groups and —COOH groups) at the surface of the toner cores, and also that stable dispersion of the toner particles in water is maintained such that the toner particles do not aggregate before a curing reaction of the capsulation material is complete. In other words, the capsulation material should have an appropriate affinity toward water which is not too large or too small.

The shell layer material may contain a single thermosetting resin, derivative of a thermosetting resin, monomer of a thermosetting resin, or prepolymer of a thermosetting resin, or may alternatively contain a mixture of two or more of such substances.

Decline in fixability can be inhibited by introducing a thermoplastic component into the capsule films (shell layers) in addition to the melamine-formaldehyde initial condensate. In order to achieve the above objective, an additional shell layer material including an alcohol —OH group that can easily be incorporated into the capsulation films (shell layers) through reaction with a methylol group of the melamine-formaldehyde initial condensate may be used in addition to the melamine-formaldehyde initial condensate. An example of the additional shell layer material is a block copolymer of sodium styrenesulfonate and a vinyl monomer including an alcohol —OH group that can react with a methylol group. The additional shell layer material is preferably a block copolymer of sodium styrenesulfonate and 2-hydroxyethyl methacrylate.

The amount of the aforementioned block copolymer used as the additional shell layer material is preferably no less than 1 part by mass and no greater than 500 parts by mass relative to 100 parts by mass of the melamine-formaldehyde initial condensate, and more preferably no less than 200 parts by mass and no greater than 400 parts by mass.

The shell layers preferably have a thickness of no greater than 20.0 nm, and more preferably no less than 1.0 nm and no greater than 10.0 nm. Sufficient fixability cannot be achieved if the shell layers are too thick. Note that the thickness of the shell layers stated above is for a composition in which the shell layers are formed by only a resin (for example, a thermosetting resin such as a melamine-based resin), and that thickness of the shell layers is not limited to the range stated above in a composition in which a modifying agent or the like is added to a resin forming the shell layers (for example, a thermosetting resin) in order to impart flexibility on the shell layers.

The thickness of a shell layers can for example be measured as described below. Toner particles are sufficiently dispersed in a cold setting epoxy resin and left to stand for two days at an ambient temperature of 40° C. to yield a hardened material. The hardened material is dyed in osmium tetroxide and subsequently a flake sample of 200 nm in thickness is cut therefrom using a microtome (for example, an EM UC6 produced by Leica Microsystems) equipped with a diamond knife. An image of a cross-section of the sample is captured by a transmission electron microscope (for example, a JSM-6700F produced by JEOL Ltd.).

The thickness of the shell layers is measured by analyzing the captured transmission electron microscopy (TEM) image using image analysis software (for example, WinROOF produced by Mitani Corporation). More specifically, on a cross-section of a toner particle, two straight lines are drawn to intersect at right angles at approximately the center of the cross-section. Next, lengths of four line segments of the two straight lines are measured at four locations at which the line segments crossed the shell layer. An average value of the lengths measured at the four locations is determined to be the thickness of the shell layer of the one toner particle subjected to the measurement. The thickness of the shell layer is measured for each of 10 or more toner particles included in the toner and an average value of the 10 measured values is used as an evaluation value.

When the shell layer is excessively thin, the TEM image may not clearly depict an interface between the core and the shell layer, complicating measurement of the thickness of the shell layer. In such a situation, the thickness of the shell layer is measured by using TEM and electron energy loss spectroscopy (EELS) in combination in order to clarify the interface between the core and the shell layer. More specifically, the thickness of the shell layer is determined by performing mapping in the TEM image using EELS for an element (nitrogen) that is characteristic of the material of the shell layer.

{Charge Control Agent (Shell Layers)}

In the present embodiment the shell layers are cationic (positively chargeable) and thus the shell layers may contain a positively chargeable charge control agent.

{External Additive}

An external additive is caused to adhere to the surface of the shell layers in order to improve fluidity and handleability of the toner particles. Note that toner particles which have not yet been treated with the external additive are referred to below as "toner mother particles". In order to improve fluidity and handleability, the amount of the external additive is preferably no less than 0.5 parts by mass and no greater than 10 parts by mass relative to 100 parts by mass of the toner mother particles, and more preferably is no less than 2 parts by mass and no greater than 5 parts by mass.

The external additive is preferably silica or a metal oxide such as alumina, titanium oxide, magnesium oxide, zinc oxide, strontium titanate, or barium titanate.

In order to improve fluidity and handleability, the external additive preferably has a particle size of no less than 0.01 μm and no greater than 1 μm.

The toner according to the present embodiment can be used as a two-component developer by mixing the toner with a carrier. In such a configuration, in order to achieve desired image density and inhibit toner scattering, the amount of the toner is preferably no less than 3% by mass and no greater than 20% by mass relative to the mass of the two-component developer, and more preferably is no less than 5% by mass and no greater than 15% by mass.

{Carrier}

The carrier is for example preferably a magnetic carrier. The magnetic carrier for example includes carrier cores and resin layers coating the carrier cores. Magnetic particles may be dispersed in the resin layers coating the carrier cores.

Examples of the carrier cores include: particles of iron, oxidized iron, reduced iron, magnetite, copper, silicon steel, ferrite, nickel, or cobalt; and particles of an alloy of any of the aforementioned materials and a metal such as manganese, zinc, or aluminum. The carrier cores may alternatively be particles of an iron-nickel alloy or an iron-cobalt alloy. The carrier cores may alternatively be particles of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate. The carrier cores may alternatively be particles of a high-dielectric substance such as ammonium dihydrogen phosphate, potassium dihydrogen phosphate, or Rochelle salt.

Examples of the resin layers coating the carrier cores include (meth)acrylic-based polymers, styrene-based polymer, styrene-(meth)acrylic-based copolymers, olefin-based polymers (for example, polyethylene, chlorinated polyethylene, and polypropylene), polyvinyl chloride, polyvinyl acetate, polycarbonates, cellulose resins, polyester resins, unsaturated polyester resins, polyamide resins, polyurethane resins, epoxy resins, silicone resins, fluororesins (for example, polytetrafluoroethylene, polychlorotrifluoroethylene, and polyvinylidene fluoride), phenolic resins, xylene resins, diallyl phthalate resins, polyacetal resins, and amino resins.

In order to improve magnetism and fluidity, the carrier preferably has a particle size of no less than 20 μm and no greater than 120 μm, and more preferably no less than 25 μm and no greater than 80 μm. The particle size can for example be measured by examining the carrier using an electron microscope.

The following explains a method of manufacturing the toner according to the present embodiment.

In order to manufacture the toner, first anionic cores are formed (prepared) and subsequently cationic shell layers are formed over the surface of the cores. The above yields toner mother particles that are for example subsequently washed using water and then dried using a dryer or the like. Next, an external additive is caused to adhere to the surface of the toner mother particles. Through the above, toner particles are formed that each include an anionic core and a cationic shell layer coating the surface of the core, and thus a toner including a large number of such toner particles is manufactured.

The following explains, in order, core formation, shell layer formation, washing, drying, and external addition in the manufacturing method of the toner according to the present embodiment.

{Core Formation}

The cores are for example formed according to a pulverization-classification process (melt-kneading process) or an aggregation process. The aforementioned processes enable favorable dispersion of internal additives throughout a binder resin.

(Core Formation According to Pulverization-Classification Process)

A material of the binder resin and materials of the internal additives are mixed and the resultant mixture is melt-kneaded. Next, cores of a desired particle size are obtained through pulverization and classification of the resultant melt-knead. The cores can be formed more easily according to the pulverization-classification process than compared to the aggregation process.

(Core Formation According to Aggregation Process)

Fine particles containing components of the cores are caused to aggregate in an aqueous medium. More specifically, micronization of the material of the binder resin to a desired particle size is performed in an aqueous medium, thereby obtaining an aqueous dispersion containing fine particles of the binder resin (i.e., a binder resin particulate dispersion). Next, the fine particles in the binder resin particulate dispersion are caused to aggregate. Aggregated particles are formed through the above.

A preferable example of a process for causing aggregation of the fine particles of the binder resin involves adjusting the pH of the aqueous dispersion containing the fine particles, subsequently adding a coagulant to the aqueous dispersion, and adjusting the temperature of the aqueous dispersion such that the fine particles aggregate. An aggregation terminating agent may be added once aggregation has proceeded to such an extent that the aggregated particles are of the desired particle size.

The aqueous dispersion is preferably adjusted to at least pH 8 when the coagulant is added. In order to ensure favorable progression of the aggregation, the temperature of the aqueous dispersion during aggregation of the fine particles is preferably at least as high as the glass transition point (Tg) of the binder resin and lower than (Tg+10)° C.

In order to ensure favorable progression of the aggregation, the additive amount of the coagulant is preferably no less than 1 part by mass and no greater than 50 parts by mass relative to 100 parts by mass of the solid phase of the aqueous dispersion. The additive amount of the coagulant can be appropriately adjusted in accordance with the type and the amount of the dispersant contained in the particulate dispersion. Addition of the coagulant may be performed through a single addition or through a series of successive additions.

The coagulant is for example an inorganic metal salt, an inorganic ammonium salt, or a metal complex having a valency of at least two. The coagulant may for example alternatively be a quaternary ammonium salt cationic surfactant or a nitrogen-containing compound (for example, polyethylenimine). Preferable examples of inorganic metal salts include metal salts (for example, sodium sulfate, sodium chloride, calcium chloride, calcium nitrate, barium chloride, magnesium chloride, zinc chloride, aluminum chloride, and aluminum sulfate) and inorganic metal salt polymers (for example, poly-aluminum chloride and poly-aluminum hydroxide). Preferable examples of inorganic ammonium salts include ammonium sulfate, ammonium chloride, and ammonium nitrate.

When two or more coagulants are used, a salt of a divalent metal is preferably used in combination with a salt of a monovalent metal. The salt of the divalent metal and the salt of the monovalent metal cause differing rates of fine particle aggregation. Therefore, by using the salt of the divalent metal in combination with the salt of the monovalent metal, particle size of the aggregated particles can be controlled to easily obtain aggregated particles having a sharp particle size distribution.

Preferable examples of the aggregation terminating agent include sodium chloride, potassium chloride, and magnesium chloride.

The binder resin particulate dispersion may also contain a surfactant. Through use of the surfactant, dispersion of the fine particles of the binder resin in the aqueous medium is stabilized. In order to improve dispersibility of the fine particles, the amount of the surfactant is preferably no less than 0.01% by mass and no greater than 10% by mass relative to the mass of the fine particles of the binder resin. The surfactant may for example preferably be an anionic surfactant, a cationic surfactant, or a non-ionic surfactant. Among such surfactants, anionic surfactants are particularly preferable.

Preferable examples of anionic surfactants include sulfate ester salt surfactants, sulfonic acid salt surfactants, phosphate acid ester salt surfactants, and soaps. Preferable cationic surfactants include amine salt surfactants and quaternary ammonium salt surfactants. Preferable non-ionic surfactants include polyethylene glycol surfactants, alkylphenol ethylene oxide adduct surfactants, and polyhydric alcohol surfactants (for example, derivatives of polyhydric alcohols such as glycerin, sorbitol, and sorbitan). The surfactants listed above may be used singly or in a combination of two or more surfactants.

Next, components included in the aggregated particles obtained through the aggregation are caused to coalesce in the aqueous medium to form the cores. The components included in the aggregated particles can for example be caused to coalesce by heating the aqueous dispersion containing the aggregated particles. In order that coalescence proceeds favorably, the aqueous dispersion containing the aggregated particles is preferably heated to a temperature at least 10° C. greater than the glass transition point Tg of the binder resin and no greater than the melting point of the binder resin. The above heating yields a core-containing aqueous dispersion.

Next, the cores are washed and subsequently dried. As a result, the cores can be collected from the core-containing aqueous dispersion.

In the aforementioned washing, the cores are for example collected from the core-containing aqueous dispersion as a wet cake through solid-liquid separation and the wet cake that is obtained is washed with water. However, the washing not limited to the process described above and any appropriate washing process may be adopted. For example, alternatively sedimentation of the cores may be caused in the core-containing aqueous dispersion, the supernatant liquid may be replaced by water, and the cores may be redispersed in the water after the replacement.

In the aforementioned drying, a dryer (for example, a spray dryer, a fluidized bed dryer, a vacuum freeze dryer, or a reduced pressure dryer) is used to dry the cores. However, the drying is not limited to the process described above and any appropriate drying process may be adopted.

The core formation process described above may be changed as appropriate in accordance with factors such as composition and intended properties of the cores. Non-essential processes (for example, the washing and the drying) may be omitted. Each of the processes should preferably be optimized in accordance with factors such as components of the cores. The following explains aggregation when cores containing a binder resin, and also containing a colorant and a releasing agent as internal additives, are formed according to the aggregation process.

When the cores contain the binder resin, the colorant, and the releasing agent, a binder resin particulate dispersion, a colorant particulate dispersion, and a releasing agent particulate dispersion are for example each prepared, and the three dispersions that are prepared are then mixed. Next, fine particles are caused to aggregate in the mixed dispersion, thereby obtaining an aqueous dispersion containing aggregated particles formed by fine particles of the binder resin, fine particles of the colorant, and fine particles of the releasing agent.

(Preparation of Binder Resin Particulate Dispersion)

Rough pulverization of the material of the binder resin is performed using a pulverizer such as a Turbo Mill. Next, the roughly pulverized product is dispersed in an aqueous medium such as ion exchanged water and the resultant dispersion is heated.

The heating temperature is preferably at least 10° C. greater than Tm of the binder resin and less than 200° C. After completion of the heating described above, strong shear force is applied using a high-speed shear emulsification device (for example, a CLEARMIX (registered Japanese trademark) produced by M Technique Co., Ltd.) or the like to obtain a dispersion of fine particles of the binder resin.

The fine particles of the binder resin preferably have a volume median diameter ($D_{50}$) of no greater than 1 μm, and more preferably no less than 0.05 μm and no greater than 0.5 μm. As a result of the volume median diameter ($D_{50}$) being in the range described above, cores having a sharp particle size distribution and uniform shape can be easily prepared. Note that in the present embodiment, the volume median diameter ($D_{50}$) is measured using a laser diffraction particle size distribution analyzer (for example, a SALD-2200 produced by Shimadzu Corporation).

When a resin including an acidic group is used as the material of the binder resin, the specific surface area of the fine particles of the binder resin increases if the resin is simply micronized in an aqueous medium. As a consequence, the pH of the aqueous medium may decrease to approximately pH 3 to 4 due to acidic groups exposed at the surface of the fine particles of the binder resin. If the pH of the aqueous medium decreases to approximately pH 3 to 4, there is a concern that hydrolysis of the fine particles of the binder resin may occur or that it may not be possible to obtain fine particles of the binder resin having a desired particle size.

In consideration of the above issue, a basic substance may be added to the aqueous medium. Examples of preferable basic substances include alkali metal hydroxides (for example, sodium hydroxide, potassium hydroxide, and lithium hydroxide), alkali metal carbonates (for example, sodium carbonate and potassium carbonate), alkali metal hydrogencarbonates (for example, sodium hydrogencarbonate and potassium hydrogencarbonate), and nitrogen-containing organic bases (for example, N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine, and vinylpyridine).

(Preparation of Colorant Particulate Dispersion)

The colorant particulate dispersion is for example prepared by dispersing the fine particles of the colorant in a surfactant-containing aqueous medium using a dispersing device.

The surfactant can for example be the same as the surfactant used in preparation of the binder resin particulate dispersion. In order to improve the dispersibility of the fine particles, the amount of the surfactant is preferably no less than 0.01 parts by mass and no greater than 10 parts by mass relative to 100 parts by mass of the colorant.

The dispersing device is for example a pressure disperser or a medium disperser. Preferable examples of pressure dispersers include an ultrasound disperser, a mechanical homogenizer, a Manton-Gaulin homogenizer, a pressure homogenizer, and a high-pressure homogenizer (for example, a high-pressure homogenizer produced by Yoshida Kikai Co., Ltd.). Preferable examples of medium dispersers include a sand grinder, a sideways or vertical bead mill, an Ultra Apex Mill (product of Kotobuki Industrial Co., Ltd.), a Dyno Mill (product of Willy A. Bachofen AG Maschinenfabrik), and an MSC Mill (product of Nippon Coke & Engineering Co., Ltd.).

The fine particles of the colorant have a volume median diameter ($D_{50}$) of no less than 0.01 μm and no greater than 0.2 μm. The volume median diameter ($D_{50}$) of the fine particles of the colorant can be measured according to the same method as the volume median diameter ($D_{50}$) of the fine particles of the binder resin.

(Preparation of Releasing Agent Particulate Dispersion)

In preparation of the releasing agent particulate dispersion, the releasing agent is pulverized in advance to approximately 100 μm or less to obtain a powder of the releasing agent. Next, the powder of the releasing agent is added to a surfactant-containing aqueous medium, thereby obtaining a slurry. In order to improve the dispersibility of the fine particles, the amount of the surfactant is preferably no less than 0.01% by mass and no greater than 10% by mass relative to the mass of the releasing agent.

The slurry which is obtained is next heated to at least the melting point of the releasing agent. Next, strong shear force is applied to the heated slurry, for example using a homogenizer (for example, an ULTRA-TURRAX T50 produced by IKA Works) or a pressure discharge disperser. Through the above process, the releasing agent particulate dispersion is prepared.

Preferable examples of devices for applying shear force include a NANO 3000 (product of Beryu Co., Ltd.), a Nanomizer (product of Yoshida Kikai Co., Ltd.), a Microfluidizer (registered Japanese trademark) (product of Microfluidics Corporation), a Gaulin homogenizer (product of SPX Corporation), and a CLEARMIX (registered Japanese trademark) W-MOTION (product of M Technique Co., Ltd.).

In order that the releasing agent is uniformly dispersed throughout the binder resin, the fine particles of the releasing agent included in the releasing agent particulate dispersion preferably have a volume median diameter ($D_{50}$) of no greater than 1 μm, more preferably no less than 0.1 μm and no greater than 0.7 μm, and particularly preferably no less than 0.28 μm and no greater than 0.55 μm. The volume median diameter ($D_{50}$) of the fine particles of the releasing agent can be measured according to the same method as the volume median diameter ($D_{50}$) of the fine particles of the binder resin.

{Shell Layer Formation}

In formation of the shell layers, first pH of a solvent is adjusted. The pH of the solvent is for example preferably adjusted to approximately pH 4 using an acidic substance. Adjustment to an acidic pH of approximately 4 promotes a polycondensation reaction of a material used to form the shell layers. Next, a cationic shell layer material is dissolved in the pH-adjusted solvent (aqueous medium).

An amino-aldehyde resin, or a derivative, monomer, or prepolymer (for example, an initial condensate) thereof, is particularly preferable as the shell layer material. Among the materials listed above, a melamine-formaldehyde initial condensate is preferable. The melamine-formaldehyde initial condensate can for example be synthesized by methylolation of melamine through reaction with formaldehyde in methanol, followed by methylation of the methylolated product.

The amount of formaldehyde added to the melamine or the amount of methanol reacting with methylol groups can be adjusted in order to produce various different product compositions in terms of composition ratios of methylol groups (—$CH_2OH$), methoxy groups (—$OCH_3$), methylene groups (—$CH_2$—), and imino groups (—NH—).

The curing temperature of the melamine-formaldehyde initial condensate tends to increase in accordance with decreasing number of imino groups. The number of methylene groups corresponds to the degree of condensation and thus when the number of methylene groups is small, a more concentrated composition containing the melamine-formaldehyde initial condensate can be obtained and shell layers having a higher degree of cross-linking can be formed. In accordance with increasing number of methylol groups, the stability of the composition containing the melamine-formaldehyde initial condensate tends to decrease and an amount of formaldehyde arising during processing tends to increase. Therefore, the number of methylol groups is preferably small.

The melamine-formaldehyde initial condensate can be easily adsorbed to an appropriate degree on the surface of anionic solid particles in a solvent (for example, an aqueous medium), and thus an in-situ polymerization reaction can readily proceed between the melamine-formaldehyde initial condensate and functional groups (for example, hydroxyl groups and carboxyl groups) at the surface of the cores (i.e., a bonding reaction with the cores). Also, in a configuration in which the melamine-formaldehyde initial condensate is used as the shell layer material, high dispersibility of the cores can be easily maintained until a curing reaction of the shell layers is complete.

Miscibility of the shell layer material during shell layer formation is preferably no less than 250% by mass and no greater than 1,000% by mass. As a result of the miscibility being in the aforementioned range, the shell layer material has an appropriate affinity toward the solvent (for example, an aqueous medium). Therefore, strong bonding can occur between the shell layer material (for example, a melamine-formaldehyde initial condensate) and the surface of the cores while high dispersibility of the cores is maintained during shell layer formation. Note that the aforementioned miscibility refers to the solubility of the solvent (for example, an aqueous medium) with respect to the shell layer material (for example, a melamine-formaldehyde initial condensate). For example, if the miscibility is 600% by mass, an amount of solvent equal to six times (mass ratio) the amount of the shell layer material can be incorporated into the shell layer material. The miscibility tends to decrease in accordance with an increasing degree of polymerization of the shell layer material.

(Synthesis of Melamine-Formaldehyde Initial Condensate)

A reaction (methylolation reaction) between melamine and formaldehyde is for example caused to occur in a strongly alkaline methanol solution of pH 12 or higher. At least a portion of the methanol is removed by evaporation to yield an intermediate product, methanol is added to the intermediate product, and a reaction (methylation reaction) is caused to occur under acidic conditions. The above process yields a methanol solution of a melamine-formaldehyde initial condensate. The obtained solution is preferably concentrated through atmospheric distillation or reduced pressure distillation. Note that shell layer formation is preferably performed in an aqueous medium. When shell layer formation is performed in an aqueous medium, the binder resin has a low tendency to dissolve and internal additives (in particular the releasing agent) have a low tendency to be eluted.

(First Stage: Methylolation Reaction)

The methylolation reaction is for example performed in a methanol solution. The amount of methanol is preferably no less than 1.5 moles and no greater than 5 moles relative to 1 mole of melamine, and more preferably no less than 2 moles and no greater than 3 moles. If the amount (number of moles) of methanol becomes more than five times greater than the amount (number of moles) of melamine, the number of methylol groups included in the melamine-formaldehyde initial condensate tends to increase. On the other hand, if the amount (number of moles) of methanol becomes less than 1.5 times the amount (number of moles) of melamine, methylolated melamine which is produced tends to deposit during reaction, adversely affecting fluidity.

The methylolation reaction is preferably performed at pH 12 or higher. If the reaction occurs at lower than pH 12, the product (methylolated melamine) tends to deposit during reaction, adversely affecting fluidity, and the number of methylol groups included in the melamine-formaldehyde initial condensate tends to increase. No particular stipulation is made as to an upper limit for pH during the reaction, but a pH of approximately 12 is practical. The pH can be adjusted using an alkali metal hydroxide (for example, sodium hydroxide or potassium hydroxide), an alkaline earth metal hydroxide (for example, calcium hydroxide), or a metal oxide (for example, calcium oxide or magnesium oxide). Alternatively, a combination of two or more of the above substances may be used. Sodium hydroxide is preferable for industrial use.

A methanol solution containing a high concentration of formaldehyde or paraformaldehyde is preferably used as a source of formaldehyde. The amount of formaldehyde is preferably no less than 3 moles and no greater than 6 moles relative to 1 mole of melamine, and more preferably no less than 3.5 moles and no greater than 5 moles.

The methylolation reaction is preferably performed at a temperature of no less than 50° C. and no greater than the reflux temperature, over a period of no less than 0.5 hours and no greater than 5 hours. At least a portion of the solvent methanol is preferably removed by evaporation either during the methylolation reaction or after the methylolation reaction. The evaporated methanol may be a portion of the methanol in the system or may be substantially all of the methanol in the system. The evaporation of methanol increases the concentration of the reaction liquid and decreases the amount of dissociated formaldehyde, thereby obtaining a preferable intermediate product (for example, methylolated melamine) for use in the subsequent methylation reaction. At least a portion of methanol is evaporated such that at the completion point of the methylolation reaction, the amount of dissociated formaldehyde is preferably no greater than 1.6 moles relative to 1 mole of melamine, and more preferably no greater than 1 mole.

In a preferable example, methanol is evaporated while performing the methylolation reaction at close to the reflux temperature. However, the above example is not a limitation and methanol may alternatively be evaporated after completion of the methylolation reaction. Further alternatively, the reaction liquid may be concentrated by evaporating a portion of the methanol while performing the methylolation reaction and also evaporating at least a portion of unevaporated methanol after completion of the reaction.

(Second Stage: Methylation Reaction)

The methylation reaction is for example performed by adding methanol and an acid catalyst to the methylolated melamine (intermediate product) obtained through the methylolation reaction described above, and causing a reaction between the methanol and the methylolated melamine under acidic conditions.

The amount of methanol present during the methylation reaction is preferably no less than 5 moles and no greater than 30 moles relative to 1 mole of melamine, and more preferably no less than 10 moles and no greater than 25 moles. In a situation in which methanol remains in the intermediate product of the methylolation reaction, the remaining amount is included in calculation of the total amount of methanol. If the amount of methanol (number of moles) becomes less than five times the amount (number of moles) of melamine, the number of methylene groups included in the melamine-formaldehyde initial condensate tends to increase.

The methylation reaction is preferably performed under acidic conditions of preferably no lower than pH 1 and no higher than pH 6.5, and more preferably no lower than pH 2 and no higher than pH 5. The acid catalyst used to adjust the pH may be an inorganic acid (for example, hydrochloric acid, sulfuric acid, phosphoric acid, or nitric acid) or an organic acid (for example, formic acid, acetic acid, oxalic acid, or p-toluenesulfonic acid). Alternatively, a combination of two or more of the above acids may be used.

The methylation reaction is performed at a temperature of no less than 25° C. and no greater than the reflux temperature, and preferably no less than 25° C. and no greater than 50° C., over a period of no less than 0.5 hours and no greater than 5 hours.

Upon completion of the methylation reaction, neutralization is preferably performed to pH 8.0 or higher. The neutralization can be performed using an alkali metal hydroxide (for example, sodium hydroxide or potassium hydroxide), an alkaline earth metal hydroxide (for example, calcium hydroxide), or a metal oxide (for example calcium oxide or magnesium oxide). Alternatively, a combination of two or more of the above substances may be used. The salt of neutralization that is produced as a result of the neutralization can later be removed from the reaction system at an appropriate stage. For example, the salt of neutralization may be removed directly after the neutralization or alternatively the salt of neutralization may be removed after concentration of the reaction product. Once a methanol solution of the melamine-formaldehyde initial condensate has been obtained as described above, the solution is preferably further concentrated. The concentration is typically performed by atmospheric distillation or reduced pressure distillation.

In accordance with adjustment of the reaction temperature and the reaction pH during the second stage, a polymerization reaction may occur simultaneously to the methylation reaction in competition therewith, and thus the miscibility can be controlled through the reaction conditions.

Note that in the present embodiment, a mixture of a melamine-formaldehyde initial condensate and a urea-formaldehyde prepolymer can alternatively be used as the shell layer material. The urea-formaldehyde prepolymer can for example be prepared by mixing urea and a formaldehyde aqueous solution that has been pH adjusted (preferably to pH 8.5) using triethanolamine, and causing a reaction under specific conditions (preferably at 70° C. for one hour). The amount of formaldehyde, or a formaldehyde-generating compound, that is used is preferably determined such that the amount of formaldehyde in the mixture is no less than 1.5 moles and no greater than 3 moles relative to 1 mole of urea, and more preferably no less than 2 moles and no greater than 3 moles.

Next, the cores prepared according to the process described above are added to and dispersed in a solvent having the shell layer material dissolved therein. Uniform shell layers can be formed more easily when the cores are uniformly dispersed throughout the solvent.

Good dispersion of the cores is for example preferably achieved through mechanical dispersion using a device capable of vigorously stirring the liquid dispersion. An example of the device capable of vigorous stirring is an HIVIS MIX produced by PRIMIX Corporation. However, the above is not a limitation and the cores may be dispersed according to any appropriate process.

For example, alternatively the cores may be dispersed in an aqueous medium containing a dispersant. However, if the amount of the dispersant is too large, shell layers may be formed with the dispersant attached to the surface of the cores. Bonding between the cores and the shell layers is weaker if the shell layers are formed with the dispersant attached to the cores, and thus the shell layers are more readily stripped off the cores due to application of mechanical stress or the like on the toner. In consideration of the above issue, the amount of the dispersant is preferably no greater than 75 parts by mass relative to 100 parts by mass of the cores. As a result of the amount of the dispersant being no greater than 75 parts by mass, stripping of the shell layers from the cores can be inhibited.

Preferable examples of the dispersant include sodium polyacrylate, polyparavinyl phenol, partially saponified polyvinyl acetate, isoprene sulfonic acid, polyether, isobutylene/maleic anhydride copolymer, sodium polyaspartate, starch, gelatin, gum arabic, polyvinylpyrrolidone, and sodium lignosulfonate. The substances listed above may be used singly or in a combination of two or more substances.

Next, the temperature of the solvent to which the cores have been added is adjusted to a desired temperature and is maintained at the desired temperature over a specific period of time. Shell layer formation (for example, a curing reaction) proceeds at the aforementioned temperature. During shell layer formation, the cores may contract due to surface tension, thereby causing spheroidizing of the cores which are in a softened state.

In order that shell layer formation proceeds favorably, the temperature of the solution during shell layer formation (reaction temperature) is preferably no less than 40° C. and no greater than 95° C., and more preferably no less than 50° C. and no greater than 80° C. In one example of configuration, the cores contain a binder resin having hydroxyl groups or carboxyl groups (for example, a polyester resin) and the shell layers contain an amino-aldehyde resin, or a derivative, monomer, or prepolymer thereof. In such a configuration, as a result of the temperature during shell layer formation being no less than 40° C. and no greater than 95° C., hydroxyl groups or carboxyl groups exposed at the surface of the cores readily react with methylol groups of the resin contained in the shell layers. Consequently, covalent bonds are readily formed between the binder resin contained in the cores and the resin contained in the shell layers. Through the above, the shell layers can strongly adhere to the surface of the cores.

Next, the solvent is adjusted to a pH of, for example, 7 and is cooled to room temperature. The solvent contains toner mother particles each including an anionic core and a cationic shell layer coating the surface of the core.

The shell layer formation process described above may be changed as appropriate in accordance with factors such as composition and intended properties of the shell layers. For example, addition of the cores to the solvent may alternatively be performed before dissolution of the shell layer material in the solvent. Also, non-essential processes may alternatively be omitted.

{Washing}

Once the toner mother particles have been formed, the toner mother particles are washed. The toner mother particles are for example washed by separating a wet cake of the toner mother particles from the dispersion by filtration using a Buchner funnel and redispersing the wet cake of the toner mother particles in ion exchanged water. Washing of the toner mother particles with ion exchanged water is repeated in the same manner a plurality of times, and the initial filtrate and the filtrate from the washings are collected as waste. However, the washing of the toner mother particles is not limited to the process described above and any appropriate washing process may be adopted.

In order to inhibit fluctuations in chargeability of the toner due to ambient conditions, the filtrate preferably has an electrical conductivity of no greater than 10 μS/cm. The electrical conductivity of the filtrate can for example be measured by an electrical conductivity meter (HORIBA ES-51 produced by HORIBA, Ltd.). Note that the electrical conductivity of the filtrate can be adjusted by, for example, controlling the amount and temperature of the washing water (ion exchanged water). The amount of washing water is preferably no less than 20 L and no greater than 70 L with respect to 300 g of toner cores included in the toner mother particles, and the temperature of the washing water is preferably no less than 25° C. and no greater than 45° C.

{Drying}

The toner mother particles are dried using, for example, a spray dryer, a fluidized bed dryer, a vacuum freeze dryer, or a reduced pressure dryer. Use of a spray dryer can inhibit aggregation of the toner mother particles during drying. However, the drying of the toner mother particles is not limited to the process described above and any appropriate drying process may be adopted.

{External Addition}

Next, an external additive is caused to adhere to the surface of the toner mother particles. A preferable example of a process for causing the external additive to adhere involves mixing the toner mother particles and the external additive using a mixer such as an FM mixer or a Nauta mixer (registered Japanese trademark), wherein conditions are set such that the external additive does not become embedded in the surface of the toner mother particles. However, the external addition is not limited to the process described above and any appropriate external addition process may be adopted. For example, if a spray dryer is used in the drying process, a dispersion of an external additive such as silica can be sprayed together with the dispersion of the toner mother particles. Consequently, the drying process and the external addition process can be performed together. Note that the external addition process may be omitted in accordance with necessity thereof. In a situation in which the external addition process is omitted, the toner mother particles are equivalent to the toner particles.

Through the manufacturing method described above for the toner according to the present embodiment, a capsule toner can be obtained that has excellent fixability and that can consistently form images having desired image density. A toner such as described above is well suited for use in an image forming apparatus that uses a process such as electrophotography, electrostatic recording, or electrostatic printing.

In the present embodiment, the capsule toner particles have, at the surface thereof, a sodium concentration of no less than 200 ppm and no greater than 1,000 ppm, and preferably no less than 250 ppm and no greater than 800 ppm, as measured by an ICP spectrometer. If the sodium concentration is too low, image density after a durability test falls below a desired value. On the other hand, if the sodium concentration is too high, both initial image density and image density after a durability test fall below the desired value.

An ICP spectrometer generates an induced electric field by causing high-frequency current to flow through an induction coil wrapped around a discharge tube (torch) made of quartz glass and thereby converts, into a plasma state, argon gas which is introduced. When a mist of a sample solution (typically an aqueous solution) is introduced into the argon plasma using a nebulizer or the like, metallic elements and metalloid elements present in the solution are atomized and excited at a temperature of no less than 6,000° C. and no greater than 7,000° C. Upon the element returning to the ground state, the element emits light of a wavelength that is characteristic thereof. By detecting emitted light, the ICP spectrometer performs qualitative analysis based on the wavelength of the emitted light and quantitative analysis based on the intensity of the emitted light. A feature of ICP spectroscopy is that a calibration curve is a straight line over a wide range. In other words, ICP spectroscopy has a wide dynamic range and can be used to analyze both major components and trace components. Also, the effects of chemical interference and ionization interference are small and analysis of high-matrix samples is possible. Therefore, when compared to a large number of other analysis techniques that are significantly affected by differences in matrix composition, an ICP spectrometer which is not affected by such differences is suited to analysis of multi-component systems. In ICP spectroscopy the lower limit of detection is 10 ppb or less with respect to the majority of elements, and elements such as rare earths, Zr, Ta, P, and B that are difficult to detect by atomic absorption can be detected. Also, ICP spectroscopy has high reliability.

The ICP spectrometer may for example be an SPS7800 series, SPS3100 series, or SPS5100 series ICP Optical Emission Spectrometer produced by Seiko Instruments Inc. (Hitachi High-Tech Science Corporation), or a CIROS Mark II ICP Optical Emission Spectrometer produced by Rigaku Corporation.

The sodium concentration at the surface of the capsule toner can for example be quantified according to the following procedure using an ICP optical emission spectrometer.

First, sulfuric acid is added to the capsule toner and carbonization treatment is performed using microwaves. After the carbonization treatment, nitric acid and hydrogen peroxide are added to the treated product and decomposition treatment is performed using microwaves. The resultant product of the decomposition treatment is added to and dissolved in distilled water and the solution is accurately measured using a volumetric flask. The aqueous solution in the volumetric flask is measured by the ICP spectrometer in order to quantify the concentration of sodium and di- or trivalent metallic elements contained in the toner.

The sodium concentration can be quantified by for example measuring intensity of an emission spectrum at a wavelength of 588.995 nm and calculating the sodium concentration from the measured intensity using a calibration curve. The wavelength of 588.995 nm in the spectrum corresponds to the energy of light emitted when a valence electron excited to a 3p orbital in an excited sodium atom drops into a 3s orbital in the ground state (the aforementioned wavelength is typically referred to as a D2 line). Due to the valence electron being excited to the 3p orbital (orbital angular momentum of 1) in the excited sodium atom, the total angular momentum can have two different states of 3/2 and 1/2 depending on the electron spin of the valence electron and the orientation of the orbital angular momentum. Since there are two different excited states that differ slightly in terms of energy, light of two different wavelengths is omitted upon returning to the ground state (i.e., D1=589.592 nm and D2=588.995 nm).

The sodium concentration at the surface of the capsule toner can be adjusted to within a desired range by controlling, for example, the amount of the neutralizer (for example, sodium hydroxide) added during neutralization, the neutralization conditions (temperature at which the neutralizer is added and pH after addition of the neutralizer), and the washing conditions (electrical conductivity of the filtrate, amount of washing water, and temperature of washing water).

It is thought that when the polymerization reaction of the shell layers is performed under acidic conditions, sodium ions are taken in, as a salt, by either or both of carboxyl groups and sulfo groups present in the toner particles. The sodium ions originate from sodium hydroxide added as the neutralizer after the polymerization reaction and from a metal salt of a vinyl polymer used as part of the film forming material. Therefore, the amount of sodium ions that are present can be controlled.

Through the electrophotographic toner according to the present embodiment, it is thought that sodium ions arising during formation of the shell layers on the surface of the toner cores can be actively taken into the shell layers. As a result, excessive charging of the toner (toner particles) can be inhibited. Therefore, charge of the toner can be inhibited from excessively increasing when printing is performed repeatedly, thereby inhibiting reduction in image density due to the repeated printing. For the reasons explained above, the electrophotographic toner according to the present embodiment enables formation of images having stable image density.

EXAMPLES

The following explains Examples of the present disclosure and also Comparative Examples. However, the present disclosure is of course not limited to the Examples.

Example 1

(Preparation of Low-Melting Toner Cores)

A polyester resin was prepared by causing a reaction between para-phthalic acid and an alcohol produced through addition of ethylene oxide to a bisphenol A framework (ethylene oxide additive-bisphenol A). The polyester resin had an OHV of 20 mg KOH/g, an AV of 40 mg KOH/g, a Tm of 100° C., and a Tg of 48° C. Next, 100 parts by mass of the polyester resin were mixed with 5 parts by mass of C.I. Pigment Blue 15:3 (phthalocyanine pigment) as a colorant and 10 parts by mass of ester wax (WEP-3 produced by NOF Corporation) as a releasing agent using a mixer (FM mixer). The resultant mixture was kneaded using a twin screw extruder (PCM-30 produced by Ikegai Corp.) and a kneaded chip was pulverized to 6 μm using a mechanical pulverizer (Turbo Mill produced by Freund-Turbo Corporation). Next, the pulverized product was classified using a classifier (ELBOW-JET produced by Nittetsu Mining Co., Ltd.) to obtain toner cores having a volume median diameter ($D_{50}$) of 6 μm. The toner cores had a shape index of 0.93, a glass transition point (Tg) of 49° C., and a softening point (Tm) of 90° C. The toners cores had a triboelectric charge (anionic strength) of —20 μC/g when measured with a standard carrier N-01. The toner cores also has a zeta potential of −15 mV at pH 4, clearly indicating that the toner cores were anionic. The following explains how the above properties of the toner cores were measured.

{Particle Diameter}

The volume median diameter ($D_{50}$) was measured using a Coulter Counter Multisizer 3 produced by Beckman Coulter, Inc.

{Shape Index}

The shape index was calculated as a degree of roundness using a flow particle imaging analyzer (FPIA (registered Japanese trademark) 3000 produced by Sysmex Corporation). More specifically, in each sample the roundnesses of 3,000 particles were measured and an average value of the measured values was used as an evaluation value.

{Tg of Toner Cores}

Tg of the toner cores was measured by plotting a heat absorption curve using a differential scanning calorimeter (DSC-6200 produced by Seiko Instruments Inc.) and calculating Tg of the toner cores from a point of change in specific heat on the heat absorption curve.

{Tm of Toner Cores}

Tm of the toner cores was measured by placing a sample in a capillary rheometer (CFT-500D produced by Shimadzu Corporation), plotting an S-shaped curve by causing melt-flow of 1 $cm^3$ of the sample using a die diameter of 1 mm, a plunger load of 20 $kg/cm^2$, and a heating rate of 6° C./minute, and reading Tm of the toner cores from the S-shaped curve that was plotted.

{Triboelectric Charge (Anionic Strength)}

A standard carrier N-01 (standard carrier for use with negative-charging toners provided by The Imaging Society of Japan) and 7% by mass of the toner cores relative to the standard carrier were mixed for 30 minutes using a tumbler mixer. Next, using the resultant mixture as a measurement sample, triboelectric charge of the toner cores when rubbed against the standard carrier was measured using a Q/m meter (Model 210HS-2A produced by TREK, Inc.).

{Zeta Potential of Toner Cores}

First, 0.2 g of the toner cores, 80 g of ion exchanged water, and 20 g of 1% concentration non-ionic surfactant (K-85 produced by Nippon Shokubai Co., Ltd.; polyvinylpyrrolidone) were mixed using a magnetic stirrer to obtain a uniform dispersion of the toner cores. The pH of the dispersion was adjusted to pH 4 through addition of dilute hydrochloric acid. Next, using the dispersion as a measurement sample, the zeta potential of the toner cores in the dispersion adjusted to pH 4 was measured using a zeta potential and particle distribution measuring apparatus (DelsaNano HC produced by Beckman Coulter, Inc.).

(Preparation of Capsulation Material)

First, 160.2 g (5 moles) of methanol was added to a four-necked flask equipped with a thermometer, a reflux condenser, and a stirring rod, and the methanol was adjusted to pH 12 using an aqueous solution of sodium hydroxide. Next, 169.7 g (5.2 moles) of paraformaldehyde (92% $CH_2O$) was added to the contents of the flask and the contents were maintained at 60° C. for 20 minutes such that the paraformaldehyde dissolved in the methanol. Next, 126.1 g (1.0 mole) of melamine was added to the contents of the flask and the contents were adjusted to pH 12 using an aqueous solution of sodium hydroxide. A reaction (methylolation reaction) was caused to occur for one hour at the reflux temperature while evaporating methanol out of the system. Next, 640.8 g (20.0 moles) of methanol was added to the intermediate product (methylolated melamine) of the aforementioned reaction and the contents of the flask were adjusted to pH 2.0 using sulfuric acid. After causing a reaction (methylation reaction) to occur at 30° C. for 3.5 hours, the reaction was terminated through neutralization treatment by adjusting the contents of the flask to pH 9 using an aqueous solution of sodium hydroxide. Next, the salt of neutralization that was produced was filtered off and the filtrate was vacuum concentrated at 0.008 MPa up to a temperature of 70° C., thereby obtaining a melamine-formaldehyde initial condensate to be used as the capsulation material (in other words, the shell forming material or the shell layer material). The melamine-formaldehyde initial condensate had a miscibility of 600% by mass and an active component concentration of 80%. Note that the miscibility (solubility of water with respect to 100% by mass of the melamine-formaldehyde initial condensate) was measured by gradually adding water to the melamine-formaldehyde initial condensate at a measurement temperature of 60° C. while stirring the measurement sample and visually observing the solubility limit (i.e., a point at which white cloudiness appeared) of the water in the melamine-formaldehyde initial condensate.

(Capsulation)

First, a three-necked flask having a capacity of 3 L, and equipped with a thermometer and a stirring blade, was set up and the internal temperature of the flask was maintained at 30° C. using a water bath. Next, 1 L of ion exchanged water was added to the flask. The aqueous medium in the flask was adjusted to pH 3.5 through addition of hydrochloric acid. Next, 2.85 g of the melamine-formaldehyde initial condensate (active component concentration 80%) was added to the flask and the contents of the flask were stirred such that the melamine-formaldehyde initial condensate dissolved in the aqueous medium. Next, 300 g of the toner cores prepared as described above were added to the contents of the flask (i.e., the acidic aqueous solution including the capsulation material dissolved therein) and dispersion treatment was performed through sufficient stirring at 40° C. After the above, heating to a temperature of 70° C. was performed at a rate of 0.5° C./minute while stirring the contents of the flask and the temperature was subsequently maintained at 70° C. for one hour. After cooling the contents of the flask to 60° C. (neutralizer addition temperature), the contents were neutralized by adjustment to pH 8.0 (pH after neutralizer addition) through addition of an aqueous solution of sodium hydroxide (neutralizer). The contents of the flask were subsequently cooled to 40° C. to yield a dispersion containing toner mother particles. Through the above, a capsule toner was obtained in which cationic shell layers were disposed over the surface of toner cores.

(Washing)

Once the toner mother particles had been formed, the toner mother particles were washed. The toner mother particles were washed by separating a wet cake of the toner mother particles from the dispersion by filtration using a Buchner funnel and redispersing the wet cake of the toner mother particles in ion exchanged water. Washing was repeated five times in the same manner using ion exchanged water. An initial filtrate and filtrates from the washings were collected as waste. Note that the washing water (ion exchanged water) had a volume of 20 L and a temperature of 25° C. The filtrate had an electrical conductivity of 3.2 μS/cm as measured using an electrical conductivity meter (HORIBA ES-51 produced by Horiba, Ltd.).

(Drying)

Drying was performed after the washing described above. The toner mother particles collected from the dispersion were dried by leaving the toner mother particles at an ambient temperature of 40° C. for 48 hours.

(External Addition)

External addition was performed after the drying described above. Fine particles of hydrophobic silica (REA-200 produced by Nippon Aerosil Co., Ltd.) having a BET surface area of 130 $m^2/g$, a pH of 8.5, and a wettability with respect to methanol of 55%, were pulverized using a jet mill pulverizer (MDS-2 produced by Nippon Pneumatic Mfg. Co., Ltd.) under conditions of a pulverization pressure of 4 $kg/cm^2$ and a feed rate of 60 g/minute. The toner mother particles obtained as described above and 0.5% by mass of the pulverized product relative to the toner mother particles were mixed using an FM mixer (FM-10C produced by Nippon Coke & Engineering Co., Ltd.), thereby obtaining a mixture of the toner mother particles and the silica fine particles (i.e., toner particles). The capsule toner was prepared by sifting the toner particles using a sieve having an opening size of 87 μm.

(Preparation of Carrier)

First, 24% by mass of polyester resin (TUFTONE (registered Japanese trademark) TTR-2 produced by Kao Corporation), 74% by mass of a magnetic substance (EPT-1000 produced by Toda Kogyo Corp.), 2% by mass of a charge control agent (BONTRON (registered Japanese trademark) S-34 produced by Orient Chemical Industries Co., Ltd.), and 1% by mass of a wax (LUVAX-1151 produced by Nippon Seiro Co., Ltd.) were sufficiently mixed and the resultant mixture was melt-kneaded using a twin screw extruder (PCM-30 produced by Ikegai Corp.). Next, the kneaded product was cooled and then roughly pulverized using a rough pulverizer (UG-210KGS produced by Horai Co., Ltd.) with a path ø of 2 mm, intermediately pulverized using an intermediate pulverizer (Fine Mill FM-300N produced by Nippon Pneumatic Mfg. Co., Ltd.), and classified using a fine pulverizer (Separator DS-5UR produced by Nippon Pneumatic Mfg. Co., Ltd.) to prepare a carrier having a mass average particle size of 36 μm.

(Preparation of Developer)

A developer was prepared by mixing the capsule toner (T) and the carrier (C) (carrier for printer FS-05400DN produced by KYOCERA Document Solutions Inc.) with a ratio (T)/(C) of 8% by mass.

Examples 2-6

As shown in Table 2, the neutralization conditions (pH after neutralizer addition and neutralizer addition temperature) and the washing conditions (filtrate electrical conductivity, amount of washing water, and temperature of washing water) were changed in Examples 2-6 relative to Example 1, but in all other aspects a developer was prepared in the same manner as in Example 1.

Example 7

In Example 7, capsulation was performed using a capsulation material (in other words, a shell forming material or a shell layer material) prepared by adding 10 g of an aqueous solution of a block copolymer of 2-hydroxyethyl methacrylate and sodium styrenesulfonate (active component concentration 5%) to 2.85 g of a melamine-formaldehyde initial condensate (active component content 80%). As shown in Table 2, the neutralization conditions (pH after neutralizer addition and neutralizer addition temperature) and the washing conditions (filtrate electrical conductivity, amount of washing water, and temperature of washing water) were changed in Example 7 relative to Example 1. In all other aspects a developer was prepared in the same manner as in Example 1.

Examples 8-13

As shown in Table 2, the neutralization conditions (pH after neutralizer addition and neutralizer addition temperature) and the washing conditions (filtrate electrical conductivity, amount of washing water, and temperature of washing water) were changed in Examples 8-13 relative to Example 7, but in all other aspects a developer was prepared in the same manner as in Example 7.

Example 14

In Example 14, capsulation was performed using a urea-formaldehyde prepolymer and a melamine-formaldehyde initial condensate as a capsulation material (in other words, a shell forming material or a shell layer material), but in all other aspects a developer was prepared in the same manner as in Example 1.

(Preparation of Urea-Formaldehyde Prepolymer)

The urea-formaldehyde prepolymer was prepared by mixing 60 g of urea and 146 g of an aqueous solution containing 37% by mass of formaldehyde and adjusted to pH 8.5 using triethanolamine, and causing the resultant mixture to react at 70° C. for one hour.

(Capsulation)

First, a three-necked flask having a capacity of 3 L, and equipped with a thermometer and a stirring blade, was set up and the internal temperature of the flask was maintained at 30° C. using a water bath. Next, 1 L of ion exchanged water was added to the flask. The aqueous medium in the flask was adjusted to pH 3.5 through addition of hydrochloric acid. Next, 6 g of the urea-formaldehyde prepolymer (active component concentration 38%) and 1 g of the melamine-formaldehyde initial condensate (active component concentration 80%) were added to the flask, and the contents of the flask were stirred such that the melamine-formaldehyde initial condensate dissolved in the aqueous medium. After the above, 300 g of toner cores prepared as described above were added to the acidic aqueous solution in the flask having the capsulation material (in other words, the shell forming material or the shell layer material) dissolved therein, and dispersion treatment was performed through sufficient stirring of the contents of the flask at 40° C. Next, heating to a temperature of 70° C. was performed at a rate of 0.5° C./minute while stirring the contents of the flask and the temperature was subsequently maintained at 70° C. for one hour. After cooling the contents of the flask to 60° C. (neutralizer addition temperature), the contents were neutralized by adjustment to pH 8.0 (pH after neutralizer addition) through addition of an aqueous solution of sodium hydroxide (neutralizer). The contents of the flask were subsequently cooled to 40° C. to yield a dispersion containing toner mother particles. Other processes after the above were performed in the same manner as in Example 1, thereby obtaining a capsule toner including capsule toner particles in which cationic shell layers were disposed over the surface of toner cores.

Comparative Examples 1-4

As shown in Table 2, the neutralization conditions (pH after neutralizer addition and neutralizer addition temperature) and the washing conditions (filtrate electrical conductivity, amount of washing water, and temperature of washing water) were changed in Comparative Examples 1-4 relative to Example 1, but in all other aspects a developer was prepared in the same manner as in Example 1.

Comparative Example 5-8

As shown in Table 2, the neutralization conditions (pH after neutralizer addition and neutralizer addition temperature) and the washing conditions (filtrate electrical conductivity, amount of washing water, and temperature of washing water) were changed in Comparative Examples 5-8 relative to Example 7, but in all other aspects a developer was prepared in the same manner as in Example 7.

<<Evaluation>>

Properties of the developers prepared in the Examples and the Comparative Examples described above were evaluated according to the following criteria. The results of the evaluations are shown in Table 2.

{Shell Layer Thickness}

The thickness of the shell layers was measured according to the method described further above. In other words, the toner particles were sufficiently dispersed in a cold setting epoxy resin and left to stand for two days at an ambient temperature of 40° C. to yield a hardened material. The hardened material was dyed in osmium tetroxide and subsequently a flake sample of 200 nm in thickness was cut therefrom using a microtome (EM UC6 produced by Leica Microsystems) equipped with a diamond knife. An image of a cross-section of the sample was captured by a transmission electron microscope (JSM-6700F produced by JEOL Ltd.).

{ICP Spectroscopy}

The sodium concentration was quantified using an ICP spectrometer (ICP-OES Optima 8300 produced by PerkinElmer Japan Co., Ltd.). First, 10 g of sulfuric acid was added to 1 g of toner mother particles (capsule toner particles after drying and prior to external addition) obtained in a given one of Examples 1-14 and Comparative Examples 1-8, and carbonization treatment was performed for 5 minutes using microwaves. After the carbonization treatment, 5 mL of nitric acid and 5 mL of hydrogen peroxide were added to the treated product and decomposition treatment was performed for 30 minutes using microwaves. The resultant product of the decomposition treatment was added to and dissolved in distilled water and the solution was accurately measured using a volumetric flask such that the total volume was 100 mL. A measurement sample was prepared by making 0.01 g or 0.05 g of the obtained solution up to a volume of 10 mL using a polar solvent N-methyl-2-pyrrolidone (NMP) (i.e., dilution by a factor of 1,000 or 200). A reference liquid for plotting a calibration curve was prepared by diluting an aqueous reference liquid of 1,000 ppm elemental sodium by at least a factor of 1,000 using NMP. Also, a reagent composed of 1,000 mg/L of a commercially available yttrium reference liquid for metal analysis ($Y(NO_3)_3$ in $HCO_3$, no less than 2% by mass and no greater than 3% by mass) was diluted in the same way as the sodium reference liquid and was added to each of the measurement liquids such as to have a concentration of 1 ppm. Note that due to the sample being incompletely dissolved in the NMP and thus being present as a dispersion, the sample was stirred prior to measurement. A lower limit of detection (LOD) was calculated by multiplying a standard deviation of 10 measurements performed with respect to NMP blanks by a factor of 3. The measurement conditions are shown below in Table 1.

TABLE 1

| | |
|---|---|
| High frequency output (W) | 1,500 |
| Plasma gas flow (L/minute) | 10 |
| Auxiliary gas flow (L/minute) | 0.3 |
| Carrier gas flow (L/minute) | 0.60 |
| Oxygen flow (L/minute) | 0.025 |
| Injector | Alumina, internal diameter 2.0 mm |
| Sample introdution system | Glass concentric nebulizer (SeaSpray)<br>Glass cyclonic chamber<br>(Oxygen support, baffle-type) |
| Sample introduction | Negative pressure suction<br>(UniFit 0.5 mm i.d.) |
| Observation direction | Measurement by axial-view<br>photometry only |
| Integral time | 3 × 5-second integrals |

{Quantification of Sodium Concentration}

The sodium concentration was quantified by measuring the intensity of an emission spectrum at a wavelength of 588.995 nm and calculating the sodium concentration from the measured intensity using a calibration curve illustrated in FIG. 1.

{Image Density Stability}

A printer (FS-05400DN produced by KYOCERA Document Solutions Inc.) having the developer prepared in given one of the Examples or Comparative Examples loaded into a cyan developing device thereof and the capsule toner prepared in the aforementioned Example or Comparative Example loaded into a cyan toner container thereof, was used to print an initial image by printing an evaluation pattern including a solid image (i.e., adjusting development biasing such that 0.5 mg/cm$^2$ of toner is applied onto the paper surface) at standard ambient conditions (20° C. and 65% RH). The image density of the solid image (initial image) was measured using a Macbeth reflectance densitometer (RD914 produced by Sakata Inx Eng. Co., Ltd.), and was evaluated as one of the three levels shown below. Next, an image was printed by printing the evaluation pattern including the solid image (i.e., adjusting development biasing such that 0.5 mg/cm$^2$ of toner is applied onto the paper surface) after printing of 30,000 successive sheets had been performed under standard ambient conditions (20° C. and 65% RH). The image density of the solid image (image after printing 30,000 sheets) was measured using the Macbeth reflectance densitometer (RD914 produced by Sakata Inx Eng. Co., Ltd.), and was evaluated as one of the three levels shown below.

Good: Image density of 1.20 or greater

Normal: Image density of at least 1.10 and less than 1.20

Poor: Image density of less than 1.10

{Fixability}

A lower temperature limit for fixing (minimum fixable temperature) and an upper temperature limit for fixing (maximum fixable temperature) were identified under the conditions described below using a printer (FS-05400DN produced by KYOCERA Document Solutions Inc.) which had been modified so that a fixing temperature of a fixing device included therein was adjustable. The lower temperature limit for fixing (minimum fixable temperature) and the upper temperature limit for fixing (maximum fixable temperature) were identified by varying the fixing temperature in 5° C. increments from 100° C. to 200° C. under conditions of a speed of 200 mm/s and a nip interval of 8 mm. The nip passage time was 40 msec. Fixability was evaluated by developing 1.0 $mg/cm^2$ of toner on 90 $g/m^2$ paper and passing the paper through the fixing device which had been adjusted to a fixing temperature to be evaluated.

TABLE 2

| | Shell forming material | | | Neutralization conditions | | Washing Conditions | | | | | Image density stability | | | | Fixability | |
|---|---|---|---|---|---|---|---|---|---|---|---|---|---|---|---|---|
| | Melamine-formaldehyde initial condensate (g) | Urea-formaldehyde prepolymer (g) | Block copolymer* (g) | pH after neutralizer addition | Neutralizer addition temperature (° C.) | Filtrate electrical conductivity (μS/cm) | Amount of washing water (L) | Washing water temperature (° C.) | Shell layer thickness (nm) | Na dectected by ICP spectroscopy (ppm) | Initial image density (ID) | Evaluation | Image density (ID after 30,000 sheets | Evaluation | Minimum fixing temperature (° C.) | Maximum fixing temperature (° C.) |
| Example 1 | 2.85 | 0 | 0 | 8.0 | 60 | 3.2 | 20 | 25 | 8.0 | 350 | 1.30 | Good | 1.25 | Good | 140 | 185 |
| Example 2 | 2.85 | 0 | 0 | 7.5 | 55 | 2.8 | 30 | 30 | 8.0 | 300 | 1.30 | Good | 1.25 | Good | 140 | 185 |
| Example 3 | 2.85 | 0 | 0 | 7.0 | 50 | 2.5 | 30 | 30 | 8.0 | 250 | 1.30 | Good | 1.24 | Good | 140 | 185 |
| Example 4 | 2.85 | 0 | 0 | 6.5 | 40 | 2.1 | 30 | 40 | 8.0 | 200 | 1.30 | Good | 1.23 | Good | 140 | 185 |
| Example 5 | 2.85 | 0 | 0 | 8.0 | 50 | 2.7 | 30 | 30 | 8.0 | 270 | 1.30 | Good | 1.25 | Good | 140 | 185 |
| Example 6 | 2.85 | 0 | 0 | 6.5 | 50 | 2.3 | 30 | 30 | 8.0 | 230 | 1.30 | Good | 1.23 | Good | 140 | 185 |
| Example 7 | 2.85 | 0 | 10 | 8.2 | 65 | 3.5 | 40 | 25 | 9.8 | 1000 | 1.30 | Good | 1.28 | Good | 150 | 190 |
| Example 8 | 2.85 | 0 | 10 | 8.0 | 60 | 3.3 | 50 | 25 | 9.8 | 800 | 1.30 | Good | 1.28 | Good | 150 | 190 |
| Example 9 | 2.85 | 0 | 10 | 7.5 | 55 | 2.9 | 50 | 25 | 9.8 | 700 | 1.30 | Good | 1.27 | Good | 150 | 190 |
| Example 10 | 2.85 | 0 | 10 | 7.0 | 50 | 2.7 | 50 | 45 | 9.8 | 600 | 1.30 | Good | 1.27 | Good | 150 | 190 |
| Example 11 | 2.85 | 0 | 10 | 8.0 | 50 | 2.3 | 50 | 45 | 9.8 | 640 | 1.30 | Good | 1.27 | Good | 150 | 190 |
| Example 12 | 2.85 | 0 | 10 | 6.5 | 50 | 3.5 | 50 | 45 | 9.8 | 560 | 1.30 | Good | 1.27 | Good | 150 | 190 |
| Example 13 | 2.85 | 0 | 10 | 6.5 | 40 | 2.3 | 70 | 45 | 9.8 | 500 | 1.30 | Good | 1.26 | Good | 150 | 190 |
| Example 14 | 1.00 | 6 | 0 | 8.0 | 60 | 3.2 | 20 | 25 | 8.0 | 350 | 1.30 | Good | 1.25 | Good | 130 | 185 |
| Comparative Example 1 | 2.85 | 0 | 0 | 8.0 | 60 | 1.2 | 50 | 40 | 8.0 | 180 | 1.25 | Good | 1.05 | Poor | 140 | 185 |
| Comparative Example 2 | 2.85 | 0 | 0 | 7.5 | 55 | 1.1 | 60 | 45 | 8.0 | 170 | 1.21 | Good | 1.03 | Poor | 140 | 185 |
| Comparative Example 3 | 2.85 | 0 | 0 | 7.0 | 50 | 1.0 | 70 | 45 | 8.0 | 150 | 1.20 | Good | 0.99 | Poor | 140 | 185 |
| Comparative Example 4 | 2.85 | 0 | 0 | 6.5 | 40 | 0.9 | 100 | 45 | 8.0 | 120 | 1.20 | Good | 0.96 | Poor | 140 | 185 |
| Comparative Example 5 | 2.85 | 0 | 10 | 7.0 | 60 | 10.5 | 30 | 25 | 9.8 | 1200 | 1.05 | Poor | 1.04 | Poor | 150 | 190 |
| Comparative Example 6 | 2.85 | 0 | 10 | 7.0 | 60 | 12.0 | 30 | 10 | 9.8 | 1800 | 1.02 | Poor | 1.01 | Poor | 150 | 190 |
| Comparative Example 7 | 2.85 | 0 | 10 | 7.0 | 60 | 20.5 | 25 | 10 | 9.8 | 2300 | 0.98 | Poor | 0.95 | Poor | 150 | 190 |
| Comparative Example 8 | 2.85 | 0 | 10 | 8.2 | 65 | 22.0 | 20 | 10 | 9.8 | 2500 | 0.90 | Poor | 0.89 | Poor | 150 | 190 |

*Block copolymer of 2-hydroxyethyl methacrylate and sodium styrenesulfonate

As can be seen from the results in Table 2, in each of Examples 1-14, the sodium concentration as measured by ICP spectroscopy was no less than 200 ppm and no greater than 1,000 ppm, the image density of both the initial image and the image after the durability test (i.e., after printing 30,000 sheets) was stable, and fixability was good.

On the other hand, in each of Comparative Examples 1-4, the sodium concentration as measured by ICP spectroscopy was less than 200 ppm and the image density of the image after the durability test (i.e., after printing 30,000 sheets) was poor. Also, in Comparative Examples 1-4, a large amount of water tended to be necessary during the washing process.

In each of Comparative Examples 5-8, the sodium concentration as measured by ICP spectroscopy was greater than 1,000 ppm and the image density of both the initial image and the image after the durability test (i.e., after printing 30,000 sheets) was poor.

What is claimed is:

1. An electrophotographic toner comprising capsule toner particles each including:

an anionic toner core having a zeta potential at pH 4 of no greater than −5 mV; and a cationic shell layer disposed over a surface of the toner core, wherein each of the capsule toner particles has, at a surface thereof, a sodium concentration of no less than 200 ppm and no greater than 1,000 ppm as measured by an inductively coupled plasma spectrometer, a material of the shell layer contains a melamine-formaldehyde initial condensate, and the material of the shell layer further contains a block copolymer of sodium styrene sulfonate and a vinyl monomer having an alcohol —OH group that is reactive with a methylol group of the melamine-formaldehyde initial condensate.

2. An electrophotographic toner according to claim 1, wherein the block copolymer is a block copolymer of 2-hydroxyethyl methacrylate and sodium styrene sulfonate.

* * * * *